US007973625B2

(12) United States Patent
Chandrappa et al.

(10) Patent No.: US 7,973,625 B2
(45) Date of Patent: Jul. 5, 2011

(54) TOOL FREE CONTACT BLOCK

(75) Inventors: Namitha Chandrappa, Karnataka (IN); Subramanyan Ananthakrishnan, Karnataka (IN); G. Kalyana Sundaram, Karnataka (IN); Pedro Jose Riera, Barcelona (ES)

(73) Assignee: General Electric Company, Schenectady, NY (US)

( * ) Notice: Subject to any disclaimer, the term of this patent is extended or adjusted under 35 U.S.C. 154(b) by 294 days.

(21) Appl. No.: 12/133,667

(22) Filed: Jun. 5, 2008

(65) Prior Publication Data

US 2009/0302979 A1 Dec. 10, 2009

(51) Int. Cl.

| | |
|---|---|
| ***H01H 1/00*** | (2006.01) |
| ***H01H 67/02*** | (2006.01) |
| ***H01H 9/02*** | (2006.01) |
| ***H01H 9/00*** | (2006.01) |
| ***H01H 1/20*** | (2006.01) |

(52) U.S. Cl. ..... 335/198; 335/86; 335/106; 335/129; 335/131; 335/132; 335/196; 335/197; 335/202; 200/243; 200/247; 200/280

(58) Field of Classification Search ..... 335/2, 10, 335/15, 86, 106, 107, 129, 131, 132, 165, 335/167, 171, 185, 187, 188, 189, 192, 196, 335/197, 198, 202; 200/240, 243, 245, 247, 200/250, 280, 447, 443, 149 B, 151, 16 R–16 D, 200/17 R, 239, 329; 439/289, 294, 824, 700, 246

See application file for complete search history.

(56) References Cited

U.S. PATENT DOCUMENTS

| | | | | | |
|---|---|---|---|---|---|
| 2,815,420 | A | * | 12/1957 | Moyer | 200/243 |
| 2,833,885 | A | * | 5/1958 | Wells et al. | 335/129 |
| 3,215,800 | A | * | 11/1965 | Hurter et al. | 335/131 |
| 3,253,092 | A | * | 5/1966 | Landow | 200/16 A |
| 3,334,319 | A | * | 8/1967 | Herrmann et al. | 335/131 |
| 3,339,161 | A | * | 8/1967 | Conner et al. | 335/131 |
| 3,544,929 | A | * | 12/1970 | Kussy et al. | 335/126 |
| 4,443,675 | A | * | 4/1984 | Drexler et al. | 200/243 |
| 4,590,451 | A | * | 5/1986 | Miyamoto | 335/161 |
| 5,886,602 | A | * | 3/1999 | Burel et al. | 335/132 |
| 6,628,184 | B1 | * | 9/2003 | Cassagrande et al. | 335/132 |
| 6,642,823 | B2 | | 11/2003 | Passow | |
| 6,661,321 | B1 | * | 12/2003 | Chuang | 335/132 |
| 6,720,510 | B2 | | 4/2004 | Passow | |
| 6,822,173 | B1 | * | 11/2004 | Schafer | 200/16 A |
| 6,861,595 | B2 | | 3/2005 | Passow | |

* cited by examiner

*Primary Examiner* — Anh T Mai
*Assistant Examiner* — Mohamad A Musleh
(74) *Attorney, Agent, or Firm* — Global Patent Operation; Stephen G. Midgley

(57) ABSTRACT

The present invention relates to an auxiliary contact block. The auxiliary contact block comprises a housing and a tool free latching mechanism. The tool free latching mechanism further comprising a stationary member integral to the housing and a latching bar. The latching bar comprising a button in communication with a moveable member by a central body.

8 Claims, 6 Drawing Sheets

TOOL FREE CONTACT BLOCK

BACKGROUND OF THE INVENTION

This invention relates generally to global contactors and specifically to a contact block utilizing tool free mechanisms for installation and for changing the state of individual poles.

A conventional electrical contactor in one form typically comprises an electromagnetically actuated device having a magnetic core proximate an armature. Typically, a coil is electrically energized to draw the armature to the magnetic core. The electromagnetically actuated device may be a control relay, a contactor, a motor starter or the like. The armature is operatively associated with a movable device such as an actuator. With an electrical switching apparatus the actuator operates a contact assembly.

A contact assembly may be an integral component of the electrical switching apparatus or it may be an auxiliary device to be added thereto. In either case, the contact assembly typically includes a contact having a pair of stationary contacts and a movable contact. The stationary contacts are fixedly mounted in spaced relation with one another. The movable contact is mounted to the pusher. The contact assembly may provide for normally open contact operation or normally closed contact operation. In some conventional contact designs a different geometry stationary contact is used for normally open and normally closed stationary contact.

A contact block may include a multitude of contacts. However, if additional contacts are required an additional contact block must be added or an auxiliary contact block is added to the end of the contact block. In this configuration the entire contact block must be removed and replaced to increase the number of auxiliary contact blocks.

Additionally, different variations of contact assemblies may require the availability of multiple pusher or auxiliary contact block designs based on the location and orientation of the movable contacts. For example, both contacts can be normally opened, both contacts can be normally closed, one contact can be normally open and the other normally closed. Additionally, the timing of one contact opening and the other closing can also be altered. These variations necessitate additional parts inventory resulting in loss of economies of scale.

The typical contact typically has either two or four poles. If additional poles are needed, a series of single pole auxiliary contacts must be assembled individually on to the contactor. Further, each pole is either normally open or normally closed from the factory. The same device cannot be used in a changed state.

In high voltage applications arcs of electricity crosses the gap as the contacts are closed. Each time an arc occurs carbon scarring or buildup occurs. The carbon scarring over time can reduce the reliability of the contact.

Accordingly, there is a need for a contact assembly for use in an electrical switching apparatus designed to facilitate ease of use, and minimize installation and inventory cost.

BRIEF DESCRIPTION OF THE INVENTION

In one aspect, the present invention relates to an auxiliary contact block. The auxiliary contact block comprising a housing and a tool free latching mechanism. The tool free latching mechanism further comprising a stationary member integral to the housing and a latching bar. The latching bar comprising a button in communication with a moveable member by a central body.

In another aspect of the invention, a tool free mechanism for an auxiliary contact block comprises a first stationary member and a second moveable member. The second moveable member being in communication with a button. Pressure on the button moves the second moveable member from a first rested position to a second released position.

DETAILED DESCRIPTION OF THE INVENTION

It is contemplated that the teaching of the description set forth below is applicable to electric contact blocks and auxiliary contact blocks, including but not limited to normally open, normally closed, relay, timer or a motor starter contact. The present invention is therefore not intended to be limited to any particular type of electrical contact, such as in contact 100. Like reference numbers denote the same or similar features among the various views and figures.

Figure 1:
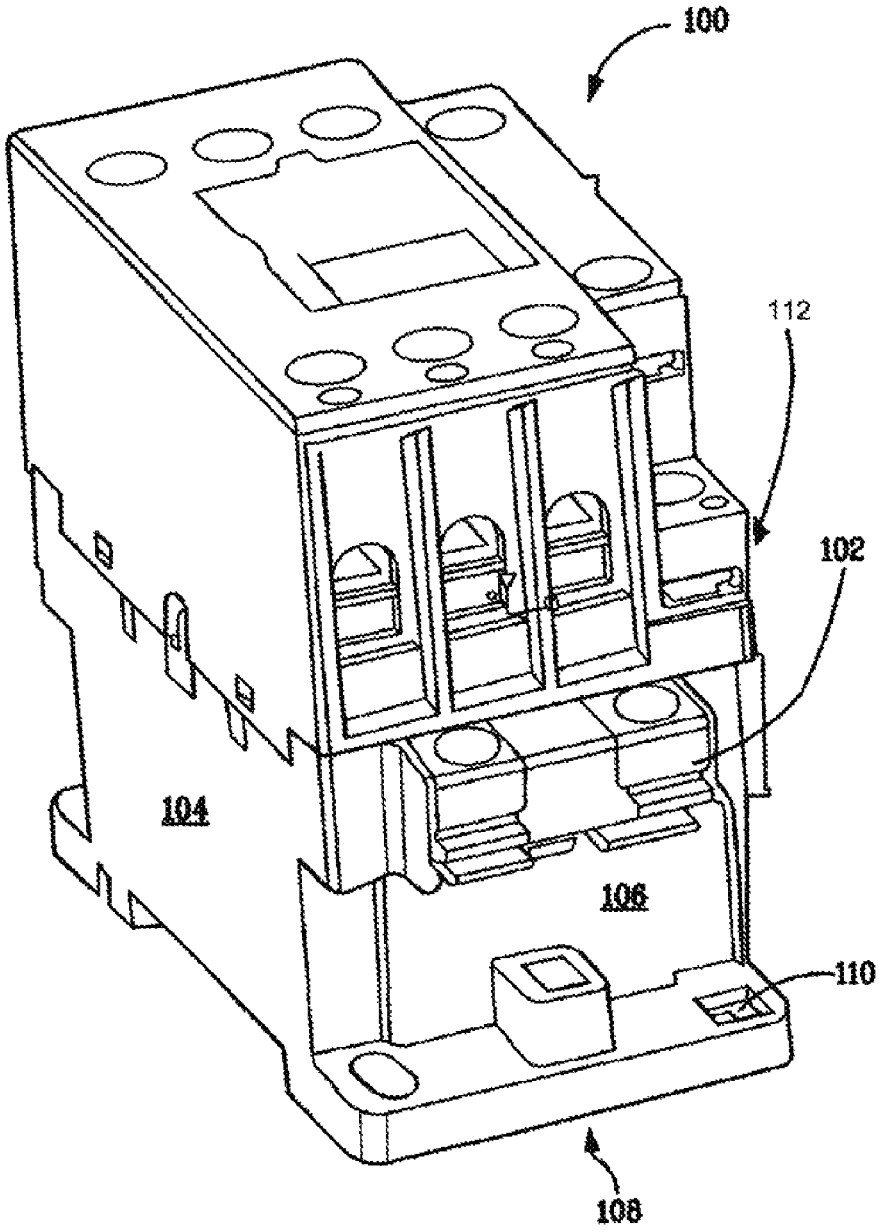
FIG. 1 is a perspective view of a contact block as is known in the industry.

FIG. 1 illustrates a contactor 100 as is known in the industry. The operation of a contactor is known in the industry and will not be described in detail. Contactor 100 may be any shape but generally has front 106, back (not visible), which is opposite the front 106, and right and left sides 104, and 112 respectively. Above contactor 100 is a frontal block 200.

Front 106 and back (not visible) comprise at least one port 102 for interconnecting wires for communication with an electric circuit. Feet 108 provide means 110 for securing contactor 100 to an enclosure by screws or bolts. A port (not shown) interfaces with a frontal block 200.

Figure 2:
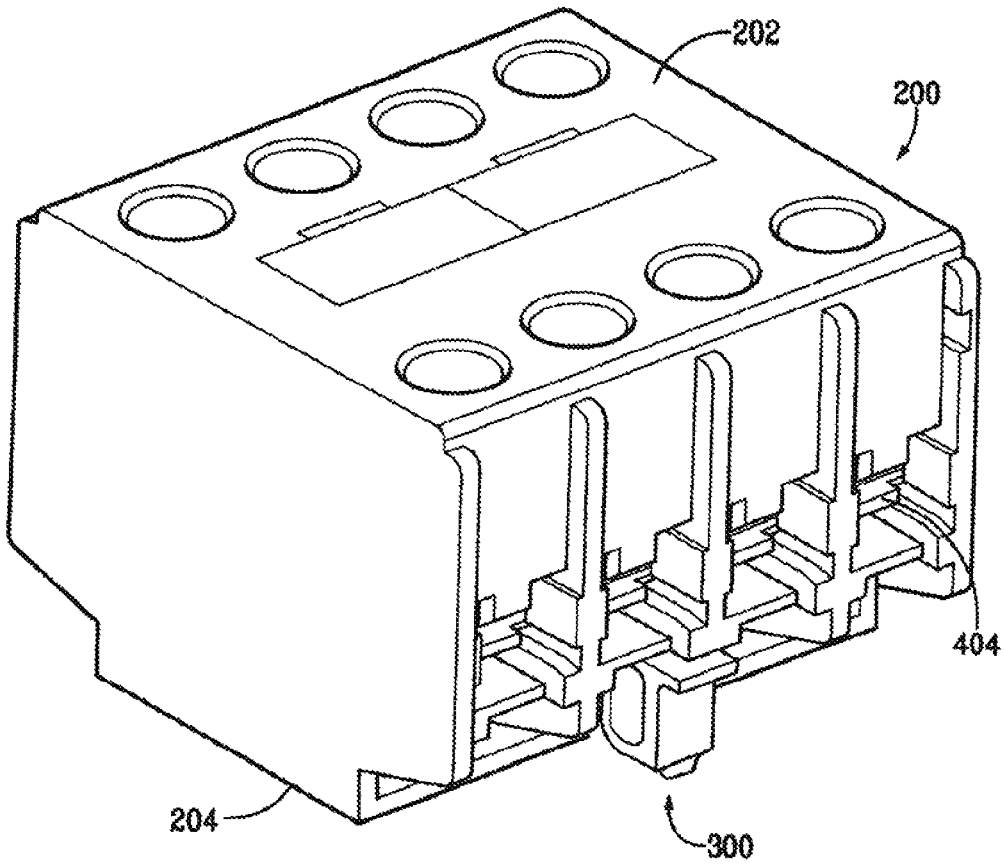
FIG. 2 is a perspective view of a 4 pole frontal block according to an aspect of the invention.

FIG. 2 is a perspective view of a frontal block 200 according to an aspect of the invention. Frontal block 200 has a cover 202 over a housing 204. Frontal block 200 is fixed to Contactor 100 by means of fixation lever 300. Wires are connected at terminal 404 for control of external electrical circuits.

Figure 3:
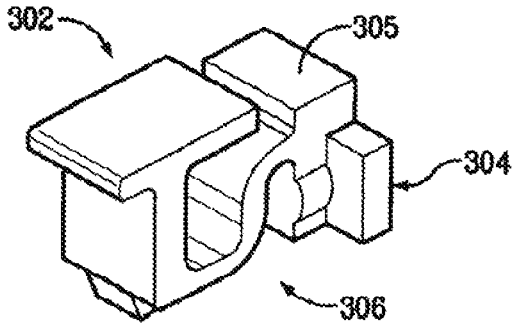
FIG. 3 is a perspective view of a fixation lever according to an aspect of the invention.
Figure 4:
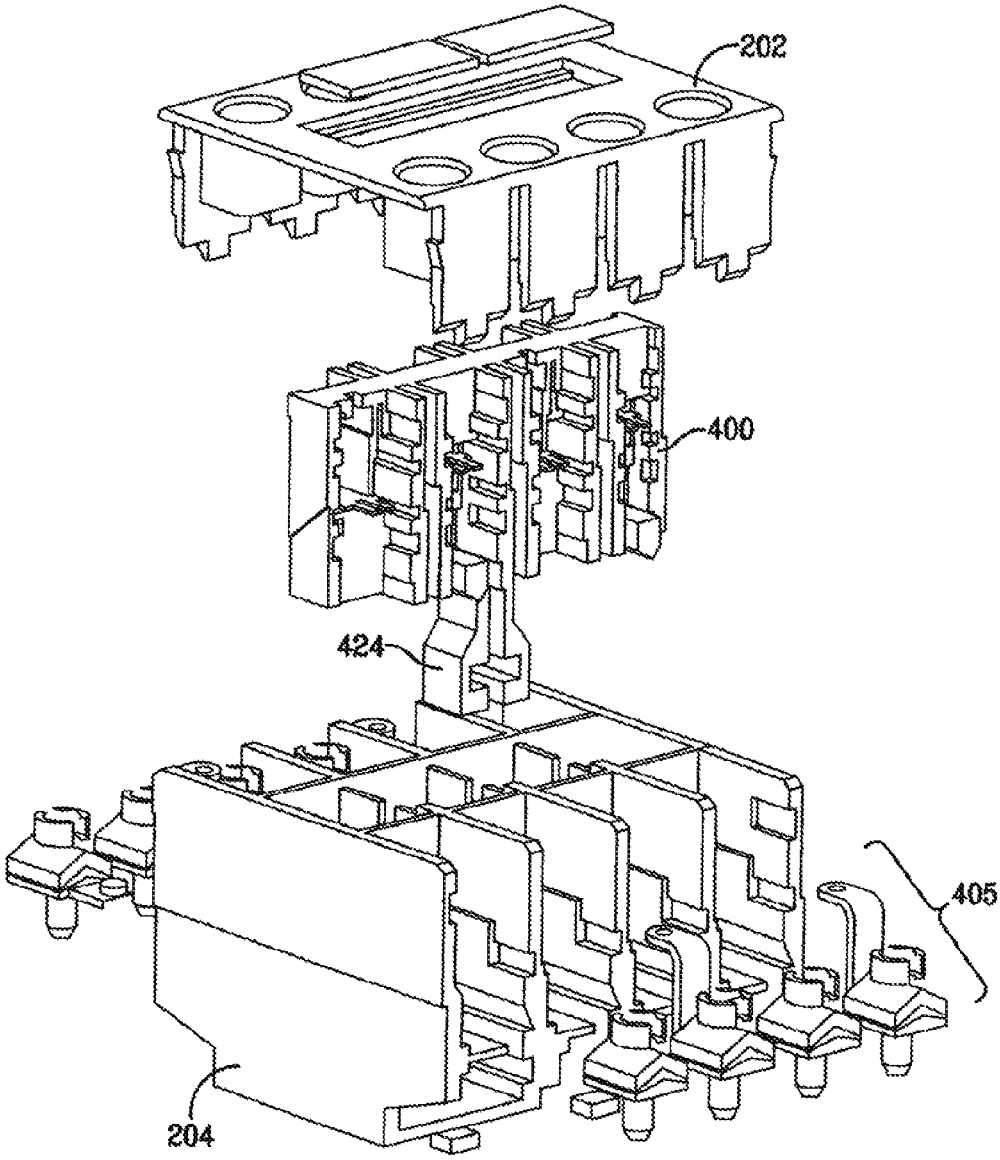
FIG. 4 is an exploded view of the 4 pole contact block of FIG. 2 according to an aspect of the invention.

The fixation lever 300 of FIG. 3 secures frontal block 200 to contactor 100. The fixation lever 300 has protrusions 304 on either side of main body 305. Protrusions 304 fit into channels (not shown) in the base of housing 204. Spring body 306 is made of a flexible material and connects main body 305 with cover interface 302. Cover interface 302 rests within a channel in housing 204. When Frontal block is assembled with contactor, the cover interface 302 rests against the wall of pocket in contactor cover (as shown in FIG. 3). By applying pressure to the top of cover interface 302 the spring body 306 flexes causing cover interface 302 to move out of the channel in housing 204 and wall in contactor cover.

Housing 204 accommodates a carrier assembly 400 and two terminal assemblies 405 on either side of carrier assembly 400. Terminal assembly 405 may contain normally open terminals, normally closed terminals or a combination of either. The configuration of each is known in the art and will not be described in detail. Carrier assembly 400 interfaces with contactor 100 through the base of housing 204 via lever 424. Motion in contactor 100 is transmitted through lever 424 causing carrier assembly 400 to move up or down in housing 204. When at a rested state the carrier assembly 400 is generally extended into housing 204.

Figure 5:
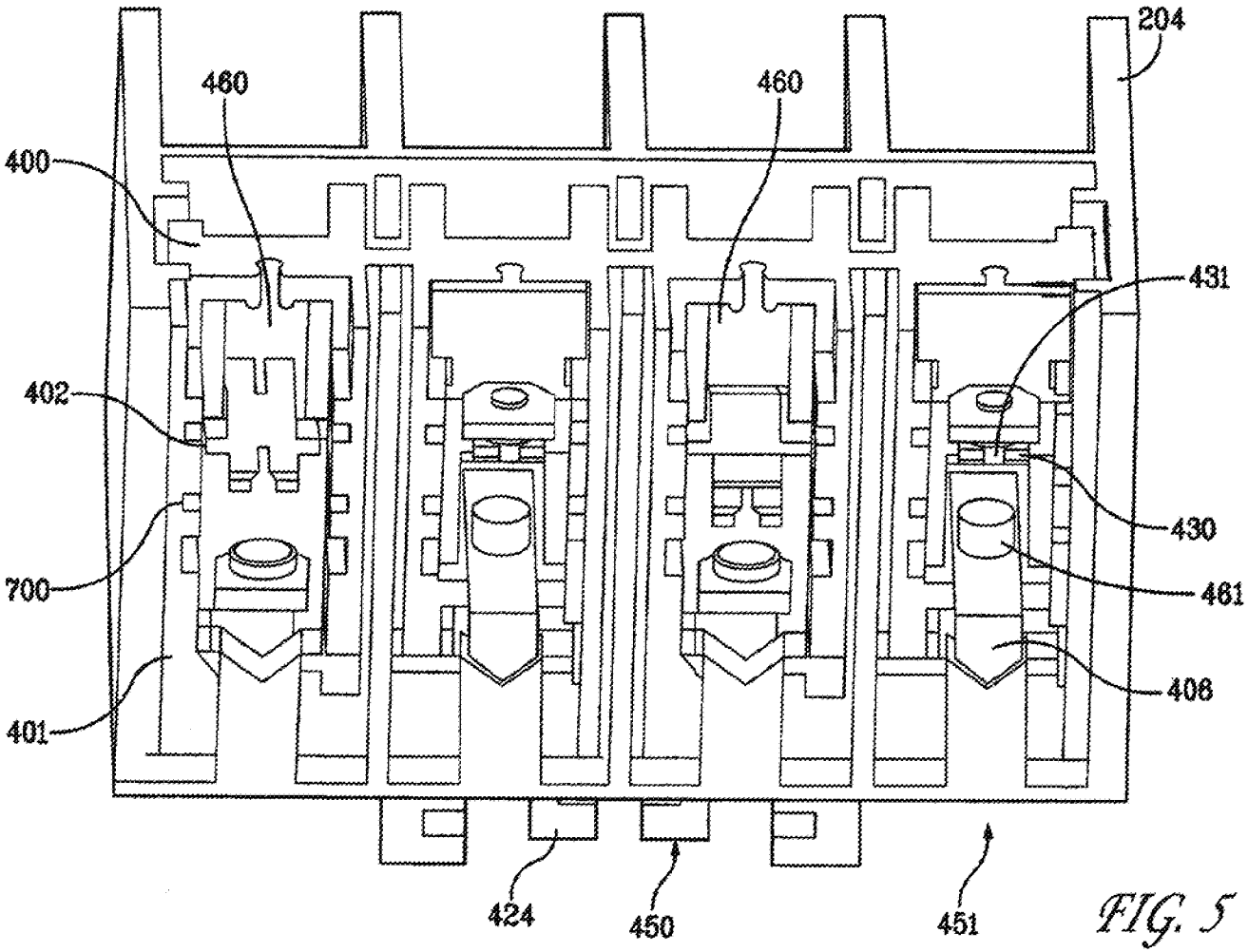
FIG. 5 is a cutaway view of the 4 pole contact block of FIG. 2 showing a carrier assembly according to an aspect of the invention.

As shown in FIG. 5, the frontal block may contain a pair of normally open contacts 450 and a pair of normally closed contacts 451. For normally open contact 450 a stationary contact 401 attached to terminal assembly 405 and rests below movable contact 402. As carrier assembly is moved from the rested position to an energized position the stationary 401 and movable 402 contacts are brought together. When the carrier assembly 400 is in the rested position the stationary 401 and movable 402 contact is offset by spacer 700. For normally closed contacts 451 a stationary contact 431 is attached to terminally assembly 405 and rests above a moveable contact 430. As carrier assembly 400 is moved from a rested position to an energized position the moveable contact 430 is removed from contact with the stationary contact 431. To prevent continued contact as the carrier assembly 400 is energized a spacer 800 constrains movable contact 430.

Figure 6:
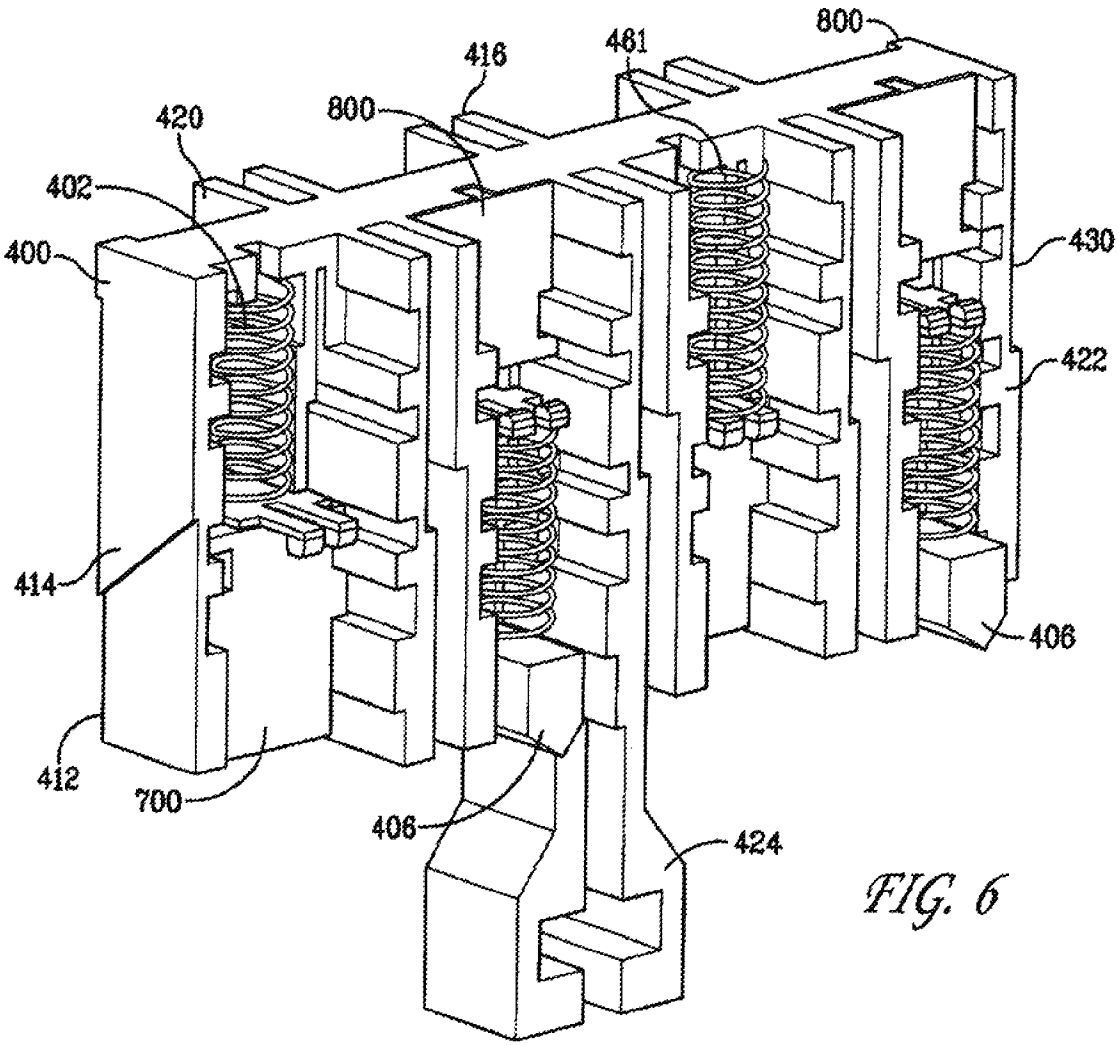
FIG. 6 is a perspective view of the carrier assembly of FIG. 5 according to an aspect of the invention.

Moveable contacts 402 and 430 are set in channels 460, 461 and are backed by springs 422, as shown in FIG. 6. The spring 422 in channel 460 is held at on end by peg 420 in carrier assembly 400 and at the other by moveable contact 402. The spring 422 in channel 461 is held at one end by spring support 406 which sits in a groove in the housing 204 and at the other end by moveable contact 430. Each channel 460, 461 may comprise a wall (not numbered) that may be inclined or angled to allow for the auto-cleaning of the contacts 402, 430 as they move up and down within the channels.

Figure 7:
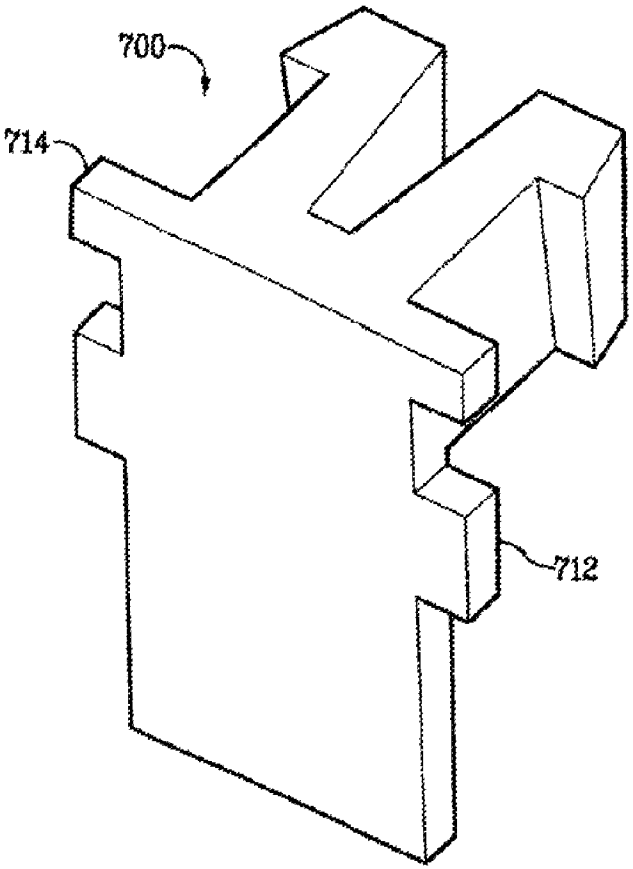
FIG. 7 is a perspective view of a normally open spacer according to an aspect of the invention.

FIG. 7 is a perspective view of spacer 700. Spacer 700 has upper protrusion 714 and lower protrusion 712. Upper protrusion 714 is inserted into groove 414 in carrier assembly 400. Lower protrusion 712 is inserted into grove 412 in carrier assembly 400. The protrusions 712 and 714 located the spacer in channel 460.

Figure 8:
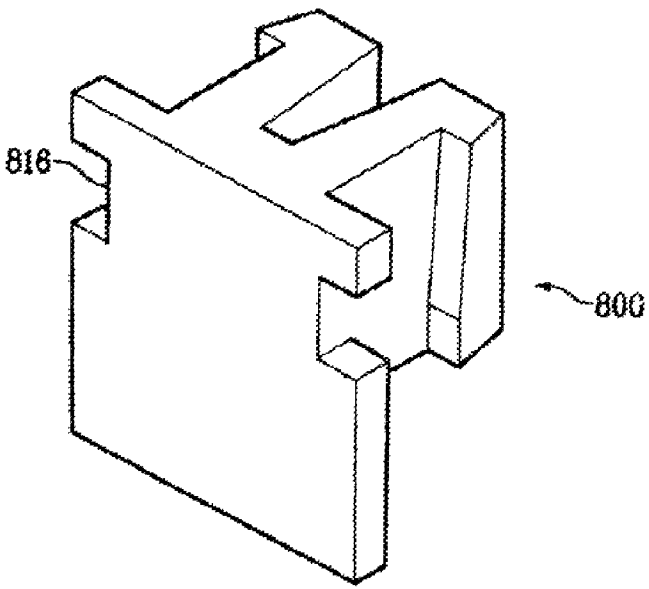
FIG. 8 is a perspective view of a normally closed spacer according to an aspect of the invention.

FIG. 8 is a perspective view of a spacer 800. Spacer 800 has groove 816 which mates with protrusion 416 in channel 461.

Each channel contains protrusions 712 and 714 as well as groove 416. Therefore any channel 460 and 461 can accommodate either spacer. By interchanging, making removable, making reversible and/or making invertible certain parts, such as the contacts 402 and 430 and the spacers 700 and 800, a normally open contact may become normally closed or a normally closed may become normally open absent use of any tools.

For example, to switch from normally open to normally closed, spacer 800 is removed and spacer 700 is inserted. The spring 422 is moved from the upper position proximate to peg 420 to a lower position supported by spring support 406. Moveable contact 402 is flipped to be in position of moveable contact 430. Stationary contact 401 is replaced with stationary contact 431. By reversing the process a normally closed contact will become normally open.

While the invention has been described in terms of various specific embodiments, those skilled in the art will recognize that the invention can be practiced with modification within the spirit and scope of the claims.

The invention claimed is:

1. An electrical contact block comprising:

a contactor;

a fixation lever; and a frontal contact block, the frontal contact block comprising:

a housing comprising a carrier assembly, at least one contact, and at least one terminal block;

the carrier assembly arranged to operably support one of a first spacer and a second spacer;

wherein the first spacer is configured to orient the at least one contact to a normally open state; and wherein the second spacer is configured to orient the at least one contact to a normally closed state; and wherein the fixation lever comprises a first end secured to the contactor and a second end engaged with the frontal contact block, the fixation lever configured to secure the frontal contact block to the contactor, and further comprising a protrusion, the fixation lever first end being operably connected to the contactor and the second end removably and slidably engaged to the frontal contact block via the protrusion.

2. The electrical contact block of claim 1, wherein the fixation lever comprises a flexible material such that pressure on the first end of the fixation lever disengages the second end from the frontal contact block.

3. The electrical contact block of claim 1, wherein the housing further comprises a channel and a groove, wherein a spring is disposed in the channel of the housing and a spring support is disposed in the groove of the housing, the spring being operably supported by the spring support at an end of the spring.

4. The electrical contact block of claim 3, wherein the first spacer and second spacer are configured to be removably disposed at one side of the contact, and the spring is located between the contact and the spring support.

5. The electrical contact block of claim 4, wherein the first spacer and second spacer are configured to be is located below the contact, and the spring support is formed integral to the housing and located above the contact.

6. The electrical contact block of claim 4, wherein the contact is inverted to one of the normally open state and the normally closed state.

7. The electrical contact block of claim 4, wherein the channel comprises an angled wall abutting the contact, the angled wall being configured to clean the contact in response to movement of the contact in the channel.

8. An electrical contact block comprising:

a contactor, a frontal contact block the frontal contact block comprising:

a housing, the housing comprising a carrier assembly, and at least one terminal block;

wherein the carrier assembly further comprises a channel and a contact disposed in the channel;

wherein the channel comprises an angled wall abutting the contact, the angled wall configured to clean the contact in response to movement of the contact in the channel; and a fixation lever having a first and a second end, the fixation lever configured to secure the frontal contact block to the contactor, and further comprising a protrusion, the fixation lever first end being operably connected to the contactor and the fixation lever second end removably and slidably engaged to the frontal contact block via the protrusion.

* * * * *